US011988427B2

(12) United States Patent
Cole

(10) Patent No.: US 11,988,427 B2
(45) Date of Patent: May 21, 2024

(54) REFRIGERANT COLD START SYSTEM

(71) Applicant: Vertiv Corporation, Columbus, OH (US)

(72) Inventor: Andrew Nathan Cole, Bellbrook, OH (US)

(73) Assignee: Vertiv Corporation, Westerville, OH (US)

( * ) Notice: Subject to any disclaimer, the term of this patent is extended or adjusted under 35 U.S.C. 154(b) by 0 days.

(21) Appl. No.: 17/730,171

(22) Filed: Apr. 26, 2022

(65) Prior Publication Data

US 2022/0349635 A1 Nov. 3, 2022

Related U.S. Application Data

(60) Provisional application No. 63/181,925, filed on Apr. 29, 2021.

(51) Int. Cl.
*F25B 45/00* (2006.01)
*F25B 39/00* (2006.01)

(52) U.S. Cl.
CPC ..... *F25B 45/00* (2013.01); *F25B 39/00* (2013.01); *F25B 2345/001* (2013.01); *F25B 2345/006* (2013.01); *F25B 2400/01* (2013.01); *F25B 2500/26* (2013.01)

(58) Field of Classification Search
CPC .... F25B 45/00; F25B 39/00; F25B 2345/001; F25B 2345/006; F25B 2400/01; F25B 2500/26
See application file for complete search history.

(56) References Cited

U.S. PATENT DOCUMENTS 3,786,651 A 1/1974 Eschbaugh et al.
3,826,104 A 7/1974 Lamb et al.
5,265,432 A * 11/1993 Luepke ..... F16N 39/005 159/901

(Continued)

FOREIGN PATENT DOCUMENTS

DE 19941398 A 8/2000
EP 1610077 A2 12/2005

(Continued)

OTHER PUBLICATIONS

International Search Report and Written Opinion of the International Searching Authorization dated Aug. 1, 2022 for International Application No. PCT/US2022/027103.

*Primary Examiner* — Henry T Crenshaw
*Assistant Examiner* — Kamran Tavakoldavani
(74) *Attorney, Agent, or Firm* — Mackey Law Firm PLLC

(57) ABSTRACT

A pumped refrigerant system can include a condenser, a pump coupled downstream of the condenser, an evaporator assembly coupled downstream of the pump, the condenser being coupled downstream of the evaporator assembly, and a refrigerant heating assembly coupled downstream of the pump, the condenser being coupled downstream of the refrigerant heating assembly. The refrigerant heating assembly can include a tank and a heating element coupled to the tank and configured to heat refrigerant within the tank. An input valve can be configured to selectively allow the pump to push refrigerant into the tank. An output valve can be configured to selectively inject heated refrigerant from the tank into plumbing upstream of the condenser.

20 Claims, 3 Drawing Sheets

(56) References Cited

U.S. PATENT DOCUMENTS

| | | | | |
|---|---|---|---|---|
| 5,999,700 | A | 12/1999 | Geers | |
| 6,438,970 | B1 | 8/2002 | Ferris et al. | |
| 8,291,719 | B2 | 10/2012 | Cowans et al. | |
| 8,479,526 | B2 | 7/2013 | Matsuoka et al. | |
| 2006/0107680 | A1 | 5/2006 | Overbeck | |
| 2017/0361677 | A1* | 12/2017 | Kim | H01M 10/663 |
| 2018/0031327 | A1* | 2/2018 | Chou | F25B 23/006 |
| 2019/0154308 | A1 | 5/2019 | Derosier | |
| 2021/0325095 | A1* | 10/2021 | Yanachi | F25B 41/20 |
| 2022/0219108 | A1* | 7/2022 | Alhashim | B01D 53/0438 |

FOREIGN PATENT DOCUMENTS

| | | | |
|---|---|---|---|
| EP | 2503265 | A2 | 9/2012 |
| WO | 2013174856 | A1 | 11/2013 |

* cited by examiner

REFRIGERANT COLD START SYSTEM

CROSS REFERENCE TO RELATED APPLICATIONS

This application claims the benefit of U.S. Provisional Patent Application No. 63/181,925 filed Apr. 29, 2021, the entire contents of which are hereby incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention. The present disclosure relates generally to refrigerant systems and more specifically relates to cold start systems for use in pumped refrigerant systems.

Description of the Related Art Pumped refrigerant systems can take on fluid temperatures proportional to their ambient environment when they are shut down for extended periods of time. When used in extreme low temperature environments, a pumped refrigerant system may not have enough heat input to adequately warm long, large diameter pipes required in some applications. When refrigerant fluid is moved through cold pipes some of the fluid condenses and this condensed fluid may get trapped in low spots in the pipe and not make it to the condenser. This can empty fluid reserves making it impossible to start the pumped refrigerant system and even may stop operation of such systems in some circumstances.

One approach is to wrap long runs of pipe with heat trace. However, such a technique warms the pipes slowly and therefore requires a long heating time. Such a technique is also inefficient, requiring significant energy input, and further complicates installation of the refrigerant system.

A need exists in the art for improved cold start of refrigerant systems.

BRIEF SUMMARY OF THE INVENTION

Applicants have created new and useful devices, systems and methods for cold start of refrigerant systems.

In at least one embodiment, a pumped refrigerant system can include a condenser, a pump downstream of the condenser, an evaporator assembly downstream of the pump, the condenser being downstream of the evaporator assembly, and a refrigerant heating assembly downstream of the pump, the condenser being downstream of the refrigerant heating assembly. In at least one embodiment, the refrigerant heating assembly can include a tank and a heating element coupled to the tank for heating refrigerant within the tank, which can include being mounted in the tank, being mounted on the tank or being otherwise configured to heat refrigerant within the tank. In at least one embodiment, the refrigerant heating assembly can include an input valve between the pump and the tank. In at least one embodiment, the input valve can be used to selectively allow the pump to push refrigerant into the tank. In at least one embodiment, the refrigerant heating assembly can include an output valve between the tank and the condenser. In at least one embodiment, the output valve can be used to selectively inject heated refrigerant from the tank into plumbing upstream of the condenser.

In at least one embodiment, the refrigerant heating assembly can be plumbed in parallel with the evaporator assembly. In at least one embodiment, the refrigerant heating assembly can receive refrigerant from plumbing between the pump and the evaporator assembly. In at least one embodiment, the refrigerant heating assembly can inject heated refrigerant into plumbing between the evaporator assembly and the condenser.

In at least one embodiment, a method for cold starting a pumped refrigerant system can include filling a tank with refrigerant from plumbing between a pump and an evaporator. In at least one embodiment, a method for cold starting a pumped refrigerant system can include sealing the refrigerant in the tank. In at least one embodiment, a method for cold starting a pumped refrigerant system can include heating the refrigerant in the tank. In at least one embodiment, a method for cold starting a pumped refrigerant system can include injecting heated refrigerant into plumbing between the evaporator and a condenser. In at least one embodiment, filling the tank can comprise opening a tank input valve, closing an expansion valve of the evaporator, and turning on the pump. In at least one embodiment, sealing the refrigerant in the tank can comprise closing a tank input valve and turning the pump off. In at least one embodiment, injecting the heated refrigerant can comprise opening a tank output valve.

In at least one embodiment, a refrigerant cycle can be started after heating the refrigerant. In at least one embodiment, a refrigerant cycle can be started before, after, and/or simultaneously with injecting the heated refrigerant.

DETAILED DESCRIPTION OF THE INVENTION

Figure 1:
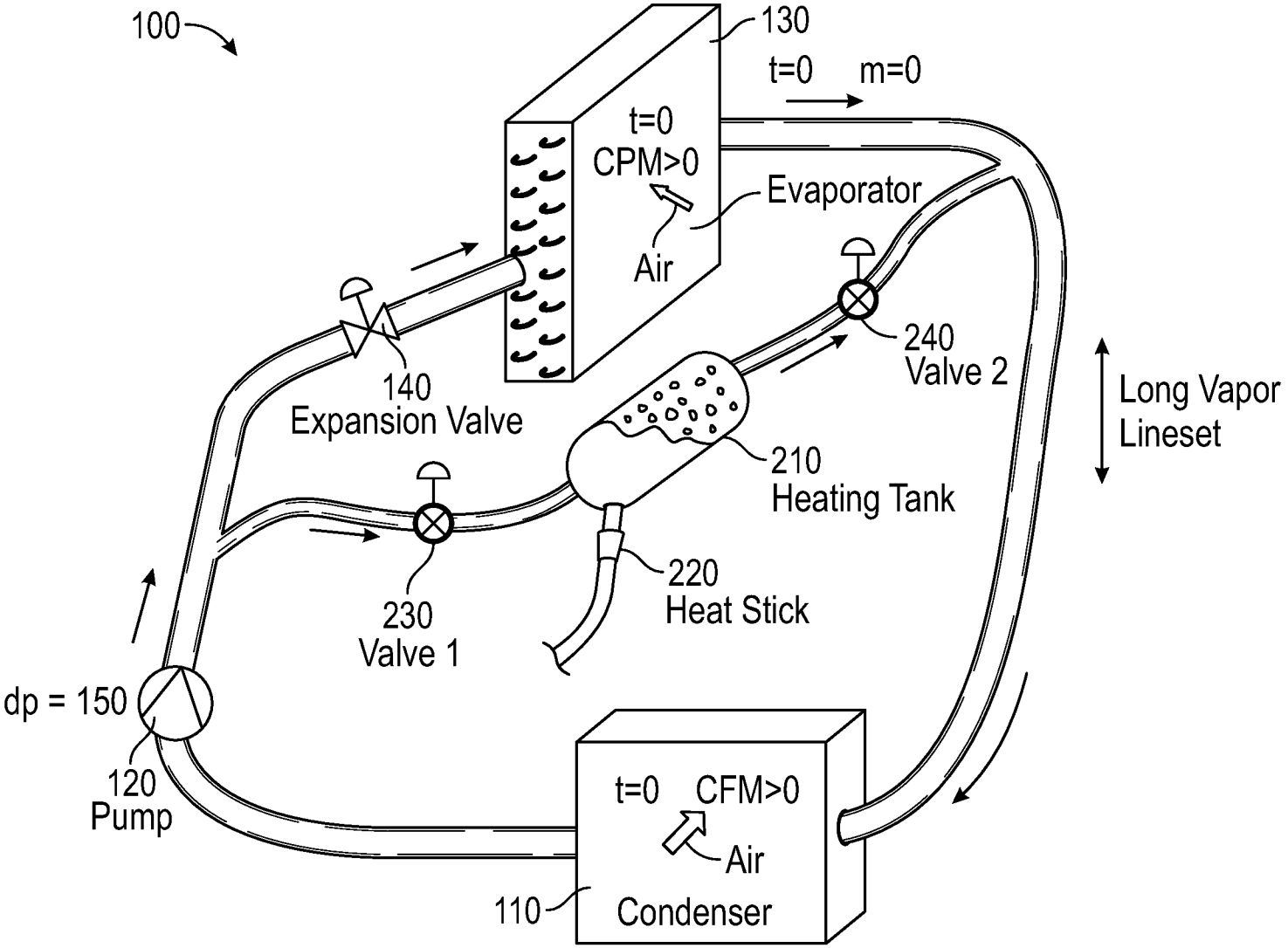
FIG. 1 is a schematic diagram of one of many embodiments of a refrigerant cold start system according to the disclosure.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms.

The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the inventions or the appended claims. The terms "including" and "such as" are illustrative and not limitative. The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and can further include without limitation integrally forming one functional member with another in a unity fashion. The coupling can occur in any direction, including rotationally. Further, all parts and components of the disclosure that are capable of being physically embodied inherently include imaginary and real characteristics regardless of whether such characteristics are expressly described herein, including but not limited to characteristics such as axes, ends, inner and outer surfaces, interior spaces, tops, bottoms, sides, boundaries, dimensions (e.g., height, length, width, thickness), mass, weight, volume and density, among others.

Figure 2:
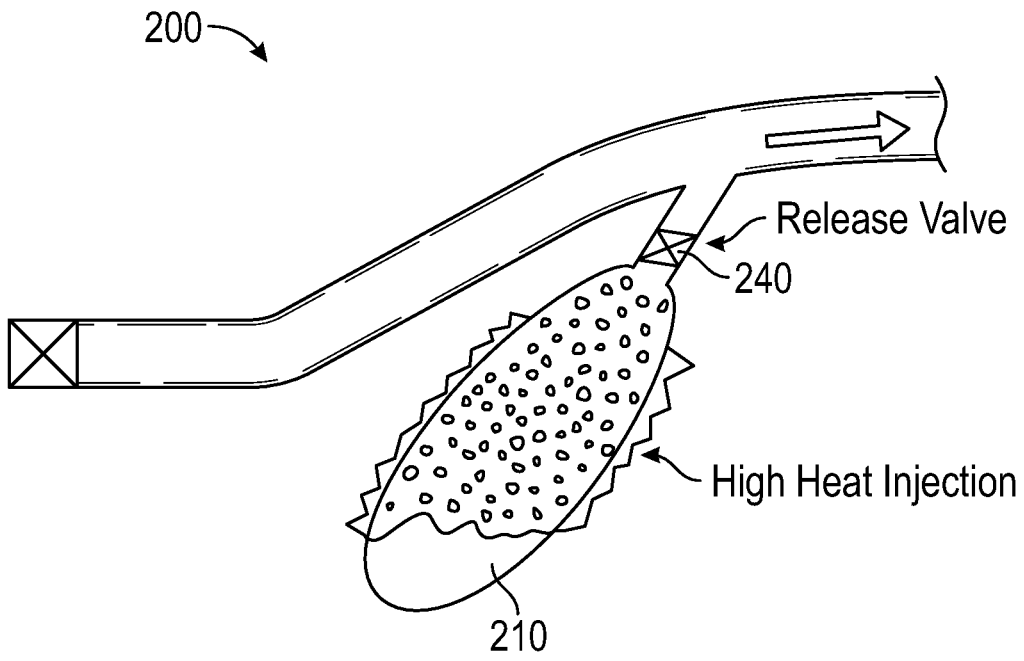
FIG. 2 is a partial schematic diagram of one of many embodiments of a refrigerant cold start system according to the disclosure.
Figure 3:
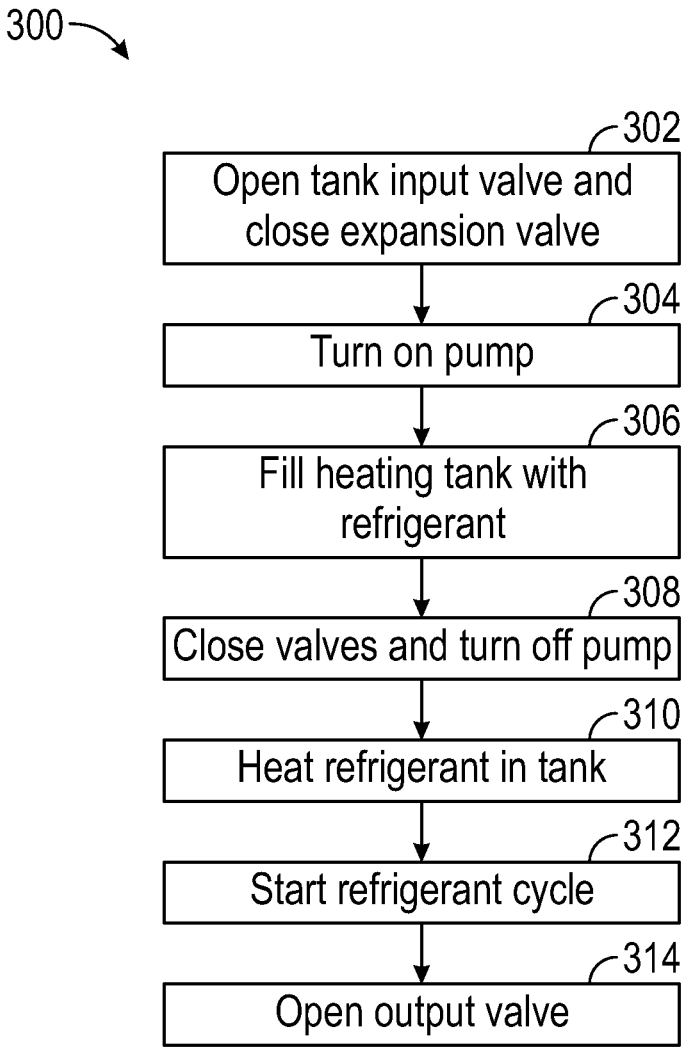
FIG. 3 is a flow chart illustrating one of many embodiments of a method for cold starting a refrigerant system according to the disclosure.

FIG. 1 is a schematic diagram of one of many embodiments of a refrigerant cold start system according to the disclosure. FIG. 2 is a partial schematic diagram of one of many embodiments of a refrigerant cold start system according to the disclosure. FIG. 3 is a flow chart illustrating one of many embodiments of a method for cold starting a refrigerant system according to the disclosure. FIGS. 1-3 will be described in conjunction with one another.

Applicants have created new and useful devices, systems and methods for cold start of refrigerant systems.

In at least one embodiment, a pumped refrigerant system can include a condenser, a pump downstream of the condenser, an evaporator assembly downstream of the pump, the condenser being downstream of the evaporator assembly, and a refrigerant heating assembly downstream of the pump, the condenser being downstream of the refrigerant heating assembly. In at least one embodiment, the refrigerant heating assembly can include a tank and a heating element coupled to the tank for heating refrigerant within the tank, which can include being mounted in the tank, being mounted on the tank or being otherwise configured to heat refrigerant within the tank. In at least one embodiment, the refrigerant heating assembly can include an input valve between the pump and the tank. In at least one embodiment, the input valve can be used to selectively allow the pump to push refrigerant into the tank. In at least one embodiment, the refrigerant heating assembly can include an output valve between the tank and the condenser. In at least one embodiment, the output valve can be used to selectively inject heated refrigerant from the tank into plumbing upstream of the condenser.

In at least one embodiment, the refrigerant heating assembly can be plumbed in parallel with the evaporator assembly. In at least one embodiment, the refrigerant heating assembly can receive refrigerant from plumbing between the pump and the evaporator assembly. In at least one embodiment, the refrigerant heating assembly can inject heated refrigerant into plumbing between the evaporator assembly and the condenser.

In at least one embodiment, a method for cold starting a pumped refrigerant system can include filling a tank with refrigerant from plumbing between a pump and an evaporator. In at least one embodiment, a method for cold starting a pumped refrigerant system can include sealing the refrigerant in the tank. In at least one embodiment, a method for cold starting a pumped refrigerant system can include heating the refrigerant in the tank. In at least one embodiment, a method for cold starting a pumped refrigerant system can include injecting heated refrigerant into plumbing between the evaporator and a condenser. In at least one embodiment, filling the tank can comprise opening a tank input valve, closing an expansion valve of the evaporator, and turning on the pump. In at least one embodiment, sealing the refrigerant in the tank can comprise closing a tank input valve and turning the pump off. In at least one embodiment, injecting the heated refrigerant can comprise opening a tank output valve.

In at least one embodiment, a refrigerant cycle can be started after heating the refrigerant. In at least one embodiment, a refrigerant cycle can be started before, after, and/or simultaneously with injecting the heated refrigerant.

In at least one embodiment, a pumped refrigerant system 100 can include a refrigerant loop comprising a condenser 110, a pump 120 plumbed downstream of the condenser 110, an evaporator assembly plumbed downstream of the pump 120, with the condenser 110 being plumbed downstream of the evaporator assembly, which can complete the refrigerant loop (e.g., depending on what, if any, other components may be included in any particular physical implementation). In at least one embodiment, the evaporator assembly can include an evaporator 130 and an expansion valve 140. In at least one embodiment, the pumped refrigerant system 100 can include a refrigerant heating assembly 200 plumbed downstream of the pump 120, the condenser 110 being plumbed downstream of the refrigerant heating assembly 200.

In at least one embodiment, the refrigerant heating assembly 200 can include a tank 210 and a heating element 220 coupled to or within the tank 210 to heat refrigerant within the tank 210. In at least one embodiment, the refrigerant heating assembly 200 can include an input valve 230. In at least one embodiment, the input valve 230 can be plumbed between the pump 120 and the tank 210. In at least one embodiment, the input valve 230 can be plumbed to a T-joint between the pump 120 and the tank 210.

In at least one embodiment, the input valve 230 can be plumbed to a T-joint between the pump 120, the evaporator assembly, and the tank 210. In at least one embodiment, the input valve 230 can be a three-way valve between the pump 120, the evaporator assembly, and the tank 210. In at least one embodiment, the refrigerant heating assembly 200 can include an input valve 230 coupled into plumbing between the pump 120 and the evaporator assembly allowing selective communication between the pump 120 and the tank 210. In at least one embodiment, the input valve 230 can be used to selectively allow the pump 120 to push, or pump, refrigerant into the tank 210.

In at least one embodiment, the refrigerant heating assembly 200 can include an output valve 240. In at least one embodiment, the output valve 240 can be plumbed between the tank 210 and the condenser 110. In at least one embodiment, the output valve 240 can be plumbed to a T-joint between the tank 210 and the condenser 110. In at least one embodiment, the output valve 240 can be plumbed to a T-joint between the tank 210, the evaporator assembly, and the condenser 110. In at least one embodiment, the output valve 240 can be three-way valve between the tank 210, the evaporator assembly, and the condenser 110. In at least one embodiment, the output valve 240 can be used to selectively inject heated refrigerant from the tank 210 into plumbing upstream of the condenser 110. In at least one embodiment, the output valve 240 can be used to selectively inject heated refrigerant from the tank 210 into plumbing downstream of the evaporator assembly.

In at least one embodiment, the refrigerant heating assembly 200 can be plumbed in parallel with the evaporator assembly. In at least one embodiment, the refrigerant heating assembly 200 can receive refrigerant from plumbing between the pump 120 and the evaporator assembly. In at least one embodiment, the refrigerant heating assembly 200 can inject heated refrigerant into plumbing between the evaporator assembly and the condenser 110.

In at least one embodiment, a method 300 for cold starting a pumped refrigerant system can include filling a tank 210 with refrigerant, as shown in step 306, from plumbing between a pump 120 and an evaporator 130. In at least one embodiment, filling the tank 210 can include opening a tank input valve 230, closing an expansion valve 140 for the evaporator 130, and turning the pump 120 on, as shown in steps 302 and 304.

In at least one embodiment, a method 300 for cold starting a pumped refrigerant system can include sealing the refrigerant in the tank 210, as shown in step 308. In at least one embodiment, sealing the refrigerant in the tank 210 can include closing the tank input valve 230 and turning the pump 120 off.

In at least one embodiment, a method 300 for cold starting a pumped refrigerant system can include heating the refrigerant in the tank 210, as shown in step 310. In at least one embodiment, the refrigerant is heated to above its critical temperature, and becomes supercritical.

In at least one embodiment, a method 300 for cold starting a pumped refrigerant system can include injecting heated refrigerant into plumbing between the evaporator 130 and a condenser 110. In at least one embodiment, injecting the heated refrigerant can include opening a tank output valve 240, as shown in step 314. In at least one embodiment, injecting the heated refrigerant can include opening the expansion valve 140. In at least one embodiment, injecting the heated refrigerant can include turning on the pump 120. In at least one embodiment, injecting the refrigerant, at above its critical temperature or in a supercritical state, quickly warms the refrigerant in the plumbing between the evaporator 130 and the condenser 110 to or above the saturation temperature of the refrigerant, which can include warming the plumbing itself to the same temperature or a different temperature.

In at least one embodiment, a refrigerant cycle can be started after the refrigerant is sufficiently heated, as shown in step 312. In at least one embodiment, a refrigerant cycle can be started before, after, and/or simultaneously with injecting the heated refrigerant. In at least one embodiment, starting a refrigerant cycle can include opening the expansion valve 140. In at least one embodiment, starting a refrigerant cycle can include turning on the pump 120.

The refrigerant heating assembly 200, as described above, improves cold starting efficiency of the pumped refrigerant system 100. For example, in at least one embodiment, the refrigerant heating assembly 200 negates the need for extra refrigerant charge. In at least one embodiment, the refrigerant heating assembly 200 warms the refrigerant and/or the plumbing between the evaporator 130 and the condenser 110 more quickly than heat elements wrapped around the plumbing, such as pipe heat trace. In at least one embodiment, the refrigerant heating assembly 200 warms the refrigerant and/or the plumbing between the evaporator 130 and the condenser 110 using less energy than heat elements wrapped around the plumbing, such as pipe heat trace.

Other and further embodiments utilizing one or more aspects of the disclosure can be devised without departing from the spirit of Applicants' disclosure. For example, the devices, systems and methods can be implemented for refrigerant cycles of numerous different types and sizes in numerous different industries. Further, the various methods and embodiments of the devices, systems and methods can be included in combination with each other to produce variations of the disclosed methods and embodiments. Discussion of singular elements can include plural elements and vice-versa. The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the inventions has been described. Obvious modifications and alterations to the described embodiments are available to those of ordinary skill in the art having the benefits of the present disclosure. The disclosed and undisclosed embodiments are not intended to limit or restrict the scope or applicability of the inventions conceived of by the Applicants, but rather, in conformity with the patent laws, Applicants intend to fully protect all such modifications and improvements that come within the scope or range of equivalents of the following claims.

What is claimed is:

1. A pumped refrigerant system, comprising:

a condenser;

a pump coupled downstream of the condenser;

an evaporator assembly coupled downstream of the pump, the condenser being coupled downstream of the evaporator assembly; and a refrigerant heating assembly coupled downstream of the pump, the condenser being coupled downstream of the refrigerant heating assembly;

wherein the refrigerant heating assembly is coupled downstream of the pump and upstream of the condenser, in parallel with the evaporator;

wherein refrigerant can flow from the pump, to the evaporator, to the condenser, and back to the pump, in that order; and wherein refrigerant can flow from the pump, to the refrigerant heating assembly, to the condenser, and back to the pump, in that order.

2. The system of claim 1, wherein the refrigerant heating assembly includes a tank and a heating element coupled to the tank and configured to heat refrigerant within the tank.

3. The system of claim 2, wherein the refrigerant heating assembly further includes an input valve between the pump and the tank, wherein the input valve is configured to selectively allow the pump to push refrigerant into the tank.

4. The system of claim 2, wherein the refrigerant heating assembly further includes an output valve between the tank and the condenser, wherein the output valve is configured to selectively inject heated refrigerant from the tank into plumbing upstream of the condenser.

5. The system of claim 1, wherein the refrigerant heating assembly is configured to receive refrigerant from plumbing between the pump and the evaporator assembly.

6. The system of claim 1, wherein the refrigerant heating assembly is configured to inject heated refrigerant into plumbing between the evaporator assembly and the condenser.

7. The system of claim 2, wherein the heating element is mounted in the tank, on the tank, or both.

8. A pumped refrigerant system, comprising:

a condenser;

a pump coupled downstream of the condenser;

an evaporator assembly coupled downstream of the pump, the condenser being coupled downstream of the evaporator assembly; and a refrigerant heating assembly coupled downstream of the pump, upstream of the condenser, and in parallel with the evaporator;

wherein refrigerant can flow from the pump, to the evaporator, to the condenser, and back to the pump, in that order; and wherein refrigerant can flow from the pump, to the refrigerant heating assembly, to the condenser, and back to the pump, in that order.

9. The system of claim 8, wherein the refrigerant heating assembly includes a tank and a heating element coupled to the tank and configured to heat refrigerant within the tank.

10. The system of claim 9, wherein the refrigerant heating assembly further includes an input valve between the pump and the tank, wherein the input valve is configured to selectively allow the pump to push refrigerant into the tank.

11. The system of claim 9, wherein the refrigerant heating assembly further includes an output valve between the tank and the condenser, wherein the output valve is configured to selectively inject heated refrigerant from the tank into plumbing upstream of the condenser.

12. The system of claim 8, wherein the refrigerant heating assembly is configured to receive refrigerant from plumbing between the pump and the evaporator assembly.

13. The system of claim 8, wherein the refrigerant heating assembly is configured to inject heated refrigerant into plumbing between the evaporator assembly and the condenser.

14. The system of claim 9, wherein the heating element is mounted in the tank, on the tank, or both.

15. A pumped refrigerant system, comprising:

a condenser;

a pump coupled downstream of the condenser;

an evaporator assembly coupled downstream of the pump, the condenser being coupled downstream of the evaporator assembly; and a refrigerant heating assembly coupled downstream of the pump, upstream of the condenser, and in parallel with the evaporator;

wherein the refrigerant heating assembly includes a tank and a heating element coupled to the tank; and wherein the heating element is configured to heat refrigerant within the tank.

16. The system of claim 15, wherein the refrigerant heating assembly further includes an input valve between the pump and the tank, wherein the input valve is configured to selectively allow the pump to push refrigerant into the tank.

17. The system of claim 15, wherein the refrigerant heating assembly further includes an output valve between the tank and the condenser, wherein the output valve is configured to selectively inject heated refrigerant from the tank into plumbing upstream of the condenser.

18. The system of claim 15, wherein the refrigerant heating assembly is configured to receive refrigerant from plumbing between the pump and the evaporator assembly.

19. The system of claim 15, wherein the refrigerant heating assembly is configured to inject heated refrigerant into plumbing between the evaporator assembly and the condenser.

20. The system of claim 15, wherein the heating element is mounted in the tank, on the tank, or both.

* * * * *